United States Patent [19]

Milholen

[11] Patent Number: 5,074,277

[45] Date of Patent: Dec. 24, 1991

[54] TENSIONING SPRING FOR BRICK CUTTER WIRES

[75] Inventor: Harold J. Milholen, Siler City, N.C.

[73] Assignee: Basic Machinery Company, Inc., Siler City, N.C.

[21] Appl. No.: 702,754

[22] Filed: May 20, 1991

[51] Int. Cl.[5] ..... B28D 1/06

[52] U.S. Cl. ..... 125/16.01; 125/17

[58] Field of Search ..... 125/16.01, 17; 83/102, 83/408, 746, 751, 761, 783

[56] References Cited

U.S. PATENT DOCUMENTS

| | | | |
|---|---|---|---|
| 3,435,815 | 4/1969 | Porcier | 125/16.01 |
| 3,478,397 | 11/1969 | Pearne et al. | 83/408 |
| 3,976,045 | 8/1976 | Coggins, Jr. | 125/16.01 |
| 4,287,869 | 9/1981 | Schmid | 125/16.01 |
| 4,393,450 | 7/1983 | Jerard | 125/16.01 |

*Primary Examiner*—M. Rachuba

*Attorney, Agent, or Firm*—Pearne, Gordon, McCoy & Granger

[57] ABSTRACT

A cutter frame for cutting unfired brick material is provided with a tensioning leaf spring having a lateral mounting portion. A cutter wire end loop is positioned over the mounting projection and is placed in substantial tension by such spring. The mounting projection is deformed by plastic deformation to provide a fully curved cutter wire loop support surface. Since the support surface for the cutter wire is curved, sharp corners are eliminated and fatigue failures in the cutter wire are substantially reduced. Further, the smooth support surface allows the wire to automatically position itself to equalize the tension in each leg of the loop.

5 Claims, 2 Drawing Sheets

TENSIONING SPRING FOR BRICK CUTTER WIRES

BACKGROUND OF THE INVENTION

This invention relates generally to the production of brick, and more particularly to cutter frames cutting unfired brick material into individual brick. Such frames are provided with novel and improved cutter wire tensioning springs structured to improve cutter wire life.

PRIOR ART

Cutter wires mounted on cutter frames have been used for many years to cut through unfired brick material during the manufacture of brick. Typically, a pug mill extrudes unfired brick material through an extrusion die as a column onto an off-bearing belt. The column is cut into slugs having a cross section of a brick and a length sufficient to be cut into a plurality of brick. These slugs are then transported to a cutter station where a cutter frame cuts the slug into individual brick. Thereafter, the green, unfired brick is dried and fired to complete the manufacture of the brick. Examples of such machines are illustrated in U.S. Pat. Nos. 3,478,297; 3,487,594; and 3,589,495, all of which are incorporated herein by reference.

The cutter frames provide a plurality of parallel, high tensile strength cutter wires having a loop at each end. One end of the cutter wire is mounted on a fixed pin which extends through one loop. A tensioning leaf spring is provided with a projecting portion extending through the other loop of each cutter wire. Positioning of the spring and the fixed pin with respect to cutter wire length is selected so that the cutter wire is placed under substantial tension by the tensioning spring. In most cases, each cutter wire also extends over a guide roller which is positioned substantially adjacent to one side of the slug during the cutting operation.

As the wire passes through the slug, the force of the green brick material on the wire causes the wire to bend. This causes the spring to bend a greater amount, and causes working between the loop and the mounting projecting portion of the spring.

In the past, the mounting projection portion of the spring has been formed by merely stamping out the spring material so that the projecting portion remains. This results in sharp corners around which the cutter wires extend with substantial tension. In some cases, the corners have been filed to reduce the sharpness of the corners; however, even after such filing, corners still exist around which the cutter wire is pulled with substantial force.

During the cutting operation, even slight relative movement of the wire at such corners causes stress concentrations and fatigue. This causes the wire to prematurely break at the corners. Further, since the sharp corners resist slippage of the wire along the wire support surface of the spring, the tension in the two legs of the loop cannot be equalized during the flexing of the spring. Therefore, one leg of the loop may be subjected to higher loads than the other. This also cause premature wire breakage where the two loop legs are twisted together. The problem of premature cutter wire failure in these manners has existed and been known for many years without solution.

SUMMARY OF THE INVENTION

The present invention provides a solution to these long existing problems.

In accordance with the illustrated embodiment, the tensioning leaf spring provides an integral projecting mounting portion which is deformed during manufacture to provide a semicylindrical wire support surface completely devoid of sharp corners. Further, during the deforming process, the height of the projection is increased to a height exceeding the thickness of the leaf spring. This permits an increase in the radius of curvature of said support surface.

With the illustrated embodiment, the loop of the associated cutter wire extends smoothly around the projecting mounting portion of the spring. Consequently, stress concentration and resulting fatigue failures in the cutter wire at the sharp corner are substantially eliminated. Further, because the support surface is smooth, the wire position along the support surface automatically adjusts to establish and maintain equal tension in the two legs of the loop. This increases the useful life of the cutter wire without requiring additional spring material, and without significantly increasing the manufacturing cost of the tensioning spring.

These and other aspects of this invention are illustrated in the accompanying drawings, and are more fully described in the following specification.

DESCRIPTION OF THE PREFERRED EMBODIMENT

Figure 2:
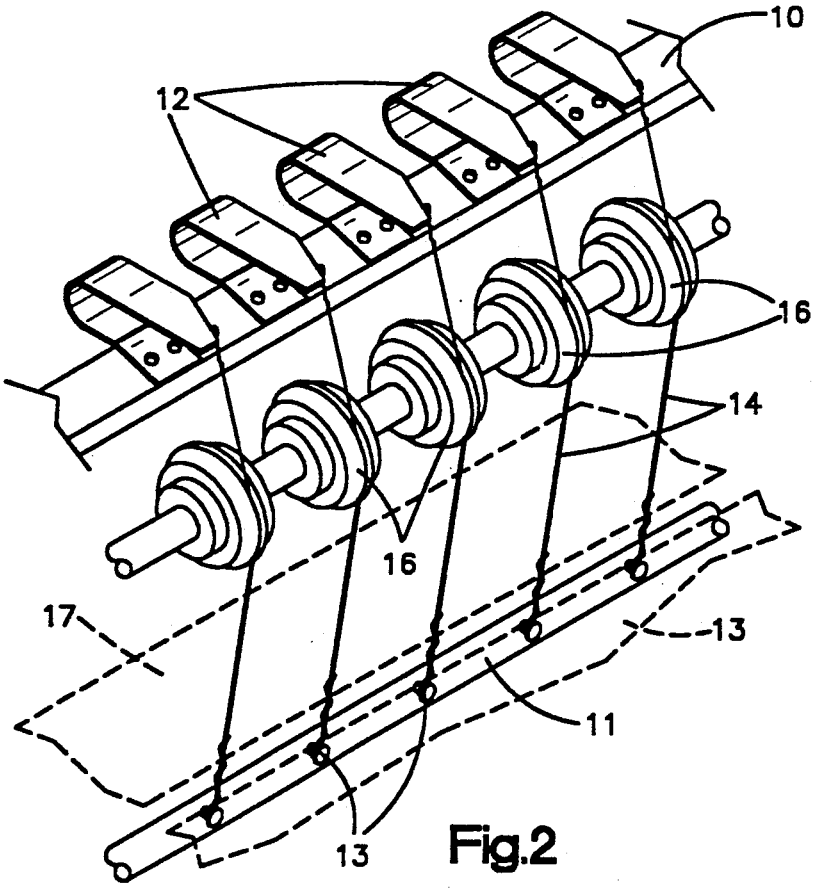
FIG. 2 is a fragmentary perspective view of a cutter frame incorporating cutter wire tensioning springs in accordance with the present invention.
Figure 2A:
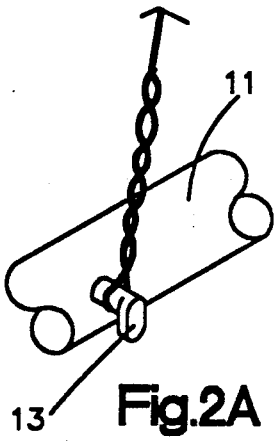
FIG. 2A is an enlarged fragmentary perspective view of a typical support pin which anchors the end of the cutter wire remote from the tensioning spring.
Figure 3:
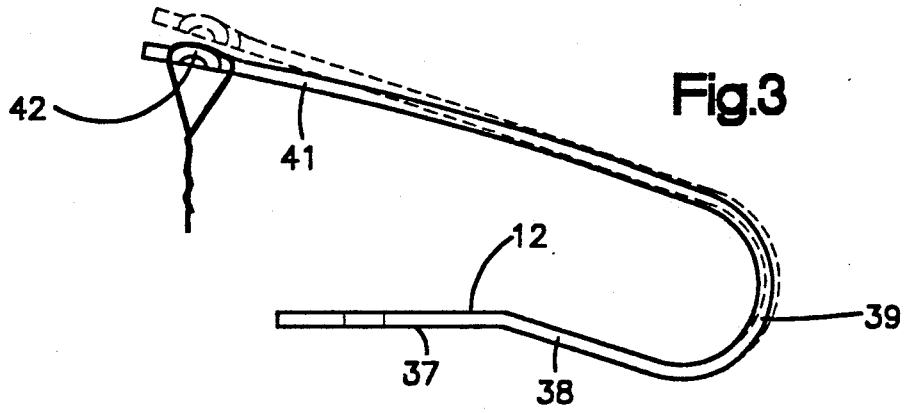
FIG. 3 is a side elevation of the tensioning spring incorporating this invention.

FIG. 2 is a fragmentary perspective view illustrating a typical cutter frame used in brick manufacturing machines to cut elongated slugs of unfired brick material into individual bricks. Such cutter frames include an upper support member 10 and a lower support member 11. Positioned along the upper support member are tensioning leaf springs 12. Mounted at similar intervals along the lower frame member 11 are fixed mounting pins 13. The mounting pins 13 and the associated tensioning springs 12 are in vertical alignment so that a plurality of cutter wires 14 connected between each mounting pin and associated leaf spring extend generally vertically therebetween and parallel to each other.

Generally, guide rolls 16 are also mounted on the cutter frame with one roll provided for each cutter wire. Each of the guide rolls provides a peripheral groove receiving the associated cutter wire to accurately laterally position each cutter wire at a location close to the upper surface of the slug being cut.

A support surface 17 (illustrated in phantom) is also provided above the lower support and below the guide rolls 16 to support the slugs of green, unfired brick material. Such support surface is provided with suitable openings through which the individual cutter wires extend during the cutting operation. The elongated slug of unfired brick material is moved laterally, usually by a pusher not shown, along the support surface 17 through the cutter wires 14 which function to cut the slug into the individual brick. The individual bricks are subsequently dried and fired to produce the finished bricks.

During such cutting operation the engagement between the wires and the brick material causes the cutter wires to flex or bend in the direction of movement of the slug and the springs function to allow such flexing movement while still maintaining sufficient tension in the cutter wires to produce the cutting operation. The cutter frame thus far described is an example of a typical cutter frame used in a modern brick manufacturing machine and is a conventional prior art structure.

Figure 1:
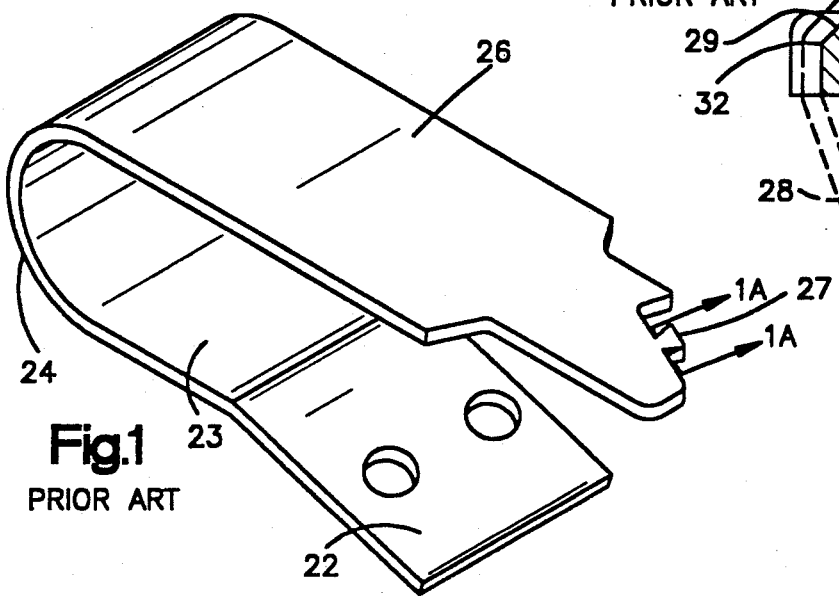
Fig.1 PRIOR ART
FIGS. 1 and 1A illustrate a typical prior art springs which have been used to tension cutter wires in brick manufacturing machinery.
Figure 1A:
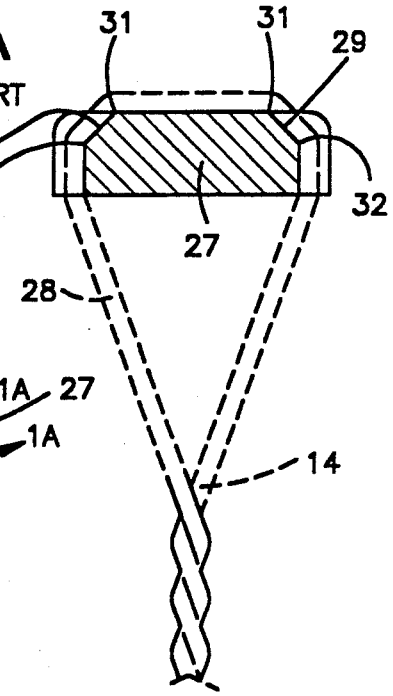
Fig.1A PRIOR ART

FIGS. 1 and 1A illustrate a conventional prior art tensioning leaf spring 21 which has been used for many years to tension cutter wires in brick manufacturing machines. Such springs have a mounting portion 22 which is secured to the upper support member 10. From the mounting portion the spring provides a rearwardly extending portion 23, a reverse bend 24, and a forwardly extending portion 26. At the forward end of the portion 26 is an integral lateral projection 27 sized to extend through an upper loop 28 (illustrated in FIG. 1A) of a cutter wire 14. The lateral projection 27 is formed during a stamping operation in which the spring material is cut to form the blank from which the spring is produced. Normally this blanking or stamping operation is performed prior to the heat treatment of the spring material to produce its spring characteristics. The blank is normally bent to the illustrated shape and subsequently heat treated to provide the required spring characteristics. Typically, the springs are about two inches wide and are formed of material approximately one-eighth of an inch thick.

Since the lateral projection 27 is formed by stamping the blank out of the spring stock, the upper corners of the lateral projection around which the loop 28 extends are quite sharp. Consequently, it has been the practice in many prior art springs to file away the edge to form a chamfer 29 at the location where the loop 28 of the cutter wire engages and is supported by the lateral projection 27. Further, the projections 27 have normally been formed to extend with increasing width from their inner end so that the loop remains seated adjacent to the inner end of the projection. By forming a chamfer by filing away the sharp corner there has been a tendency to reduce the cutter wire breakage resulting from the stress concentrations and fatigue in the wire as the cutter wire is used to cut through the unfired brick material. However, even with these chamfers premature cutter wire failure occurs in the upper loop requiring early replacement of the wires 14. Such replacement not only involves the cost of replacement cutter wires but also requires that the high production machines in which they are installed by shut down while the wires are replaced. While the existence of the chamfers 29 formed by filing each spring on each side of the lateral projection indicates a recognition that stress concentration and fatigue causes premature breakage of the wire forming the loop 28. Springs of the type illustrated in FIGS. 1 and 1A have been used for many years without a solution to such problem. Even with the chamfers 29, sharp corners exist at 31 and 32 and the problem of premature cutter wire breakage was only partially solved.

FIGS. 3 through 6 illustrate a novel and improved tensioning spring incorporating the present invention in which the problem of such premature failure of the cutter wires is virtually eliminated.

The tensioning springs 12 incorporating the present invention again include a mounting portion 37, a rearwardly extending portion 38, a reverse band 39, and forwardly extending portion 41. Preferably, the springs 12 are sized and shaped so that they can be retrofitted in existing machines as well as installed in new machines. The principle difference between the improved springs 12 and the prior art springs 21 is that the mounting projections which receive the upper loop 28 of the cutter wires 14 is modified to eliminate any sharp corners tending to produce premature fatigue failure in the upper loops 28 of cutter wires 14.

Figure 4:
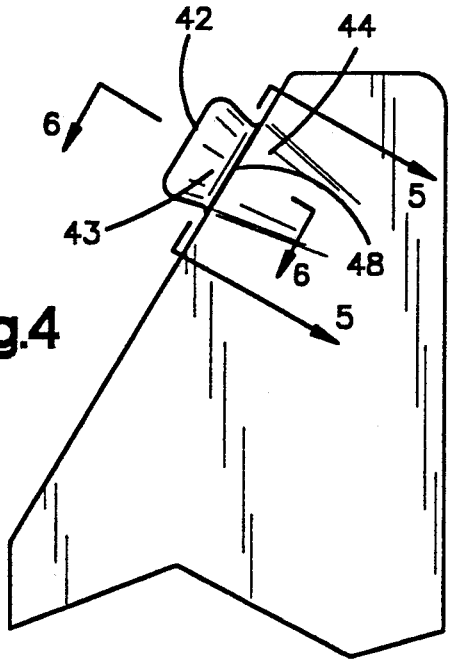
FIG. 4 is an enlarged fragmentary plan view of the spring illustrating the mounting projection.
Figure 5:
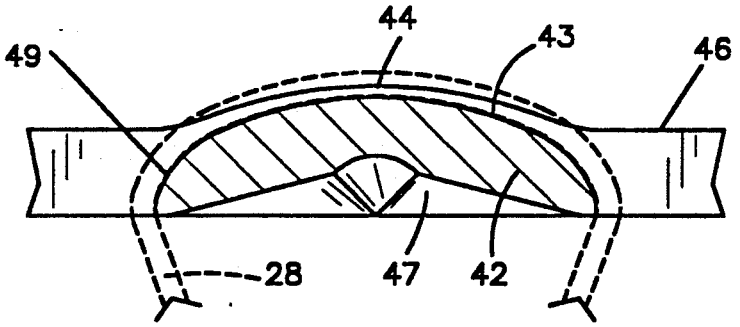
FIG. 5 is an enlarged, fragmentary section through the mounting projection taken along 5—5 of FIG. 4 and illustrating the shape of the support surface for the wire.
Figure 6:
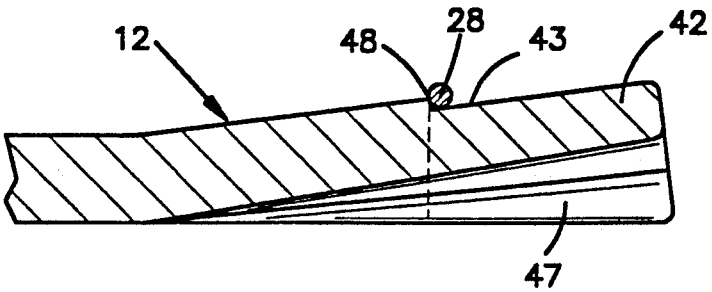
FIG. 6 is an enlarged, fragmentary lengthwise section of the mounting projection taken along 6—6 of FIG. 4.

In the tensioning springs 12 an integral lateral extending mounting projection 42 is provided having a shape best illustrated in FIGS. 4 through 6. This projection is initially produced during the stamping operation in which the blanks for the springs are cut from sheet spring stock. However, in accordance with the present invention, the mounting projections 42 along with the adjacent portion of the spring 12 is formed in dies to provide a smoothly curved wire support surface 43. Preferably, this forging deformation of the mounting projection is performed while the spring material is in a soft state prior to heat treatment to give it the required spring characteristics.

Figure 4A:
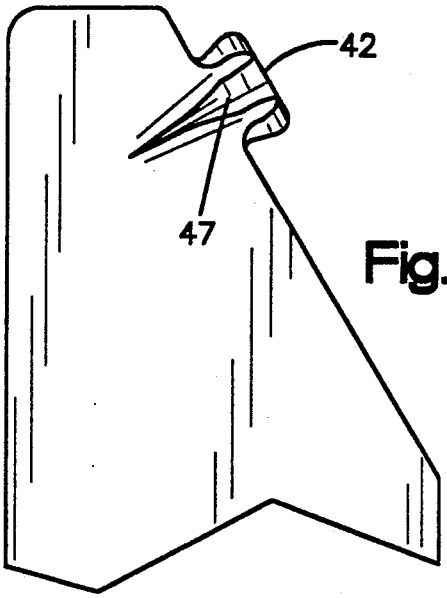
FIG. 4A is an enlarged fragmentary view similar to FIG. 4 but illustrating the bottom side of the wire mounting projection.

The dies for producing this plastic forging type deformation of the material at the mounting projection 42 cooperate to cause a displacement of the material of the spring adjacent to the mounting projection in an upward direction to form a smoothly curved portion 44 above the plane of the upper surface 46 of the spring adjacent thereto. This is accomplished by a tool penetrating into the lower surface of the spring forming a wedge-shaped concave recess 47 which tapers back from the outer end of the mounting projection 42 as best illustrated in FIGS. 4A and 6. Further, a step 48 is produced at the root of the mounting projection 42 which forms a seat for the upper loop 28 of the cutter wire as best illustrated in FIG. 6. Further, the height or chordal thickness of the curved wire support surface 43 is increased during this deforming operation so that the chordal thickness is greater than the thickness of the metal forming the spring. This permits the forming of the support surface with a greater radius of curvature. The surface 43 is substantially a semicylindrical surface having a decreased radius of curvature at its ends 49.

By deforming the material of the mounting projection 42 in this way, it is possible to provide a very smoothly curved wire support surface which eliminates all sharp corners and substantially reduces any tendency for the wire forming the upper loop 28 to fatigue and cause premature wire failure. Also, the smooth, curved support surface for the wire allows the position of the wire along such surface to automatically adjust to insure equal tension in the two legs of the loop. This reduces breakage where the two legs are twisted together to close the loop.

Further, since the shaping of the mounting projection does not require the removal of any material thereof, the strength of the projection is maintained and, if anything, increased because of the curved nature of the entire projection. Further, since the shaping of the projection and the adjacent portion of the spring is performed in a die assembly, hand working such as the filling of the prior art to form the chamfer is eliminated. With the present invention, the working between the wire and the support projection occurring during the cutting operations does not produce significant fatigue and the cost of replacing broken wires due to premature failure thereof is substantially reduced.

It should be understood that the use of the terms upper and lower in the foregoing specification is not intended to limit the invention to the particular orientation illustrated and is used merely to provide a clear description of the various interrelated parts of the structure. Further, although the invention is illustrated in connection with a typical cutter frame in which slugs of unfired brick are pushed through the cutter frame, the invention is equally applicable to other types of cutters for brick manufacturing machinery such as the cutters which cut slugs from the continuous column of brick extruded from the pug mill and also in reel-type cutters of the type illustrated in FIG. 14, the U.S. Pat. No. 3,716,264, supra.

Although the preferred embodiment of this invention has been shown and described, it should be understood that various modifications and rearrangements of the parts may be resorted to without departing from the scope of the invention as disclosed and claimed herein.

What is claimed is:

1. A cutter frame for cutting unfired brick material, comprising first and second spaced supports, a mounting pin mounted on said first support, metal wire tensioning leaf spring mounted on said second support, said leaf spring providing a projecting mounting portion, and a cutter wire formed with closed loops on each end, one loop of said wire encircling an associated one of said projecting portion and the other loop of each wire encircling said mounting pin, said leaf spring operating to apply substantial tension to said wire, said leaf spring and projecting mounting portion being formed of spring metal having a predetermined thickness, said projecting mounting portion being deformed to provide a smoothly curved substantially semicircular cutter wire support surface having a chordal thickness greater than said predetermined thickness, said semicircular surface engaging the associated cutter wire loop to apply tension thereto without producing sharp bends tending to cause stress concentration failures in the associated loop, said cutter wire operating to cut unfired brick material when said wire is passed through said unfired brick material.

2. A cutter frame as set forth in claim 1 wherein said first and second supports are elongated and parallel, a plurality of said mounting pins are mounted in intervals along the length of said first support, a plurality of said tension springs are mounted in intervals along said second support with a tension spring associated with each of said mounting pins, and a cutter wire is mounted between each mounting pin and the associated tension spring, said cutter wire operating to cut elongated slugs of unfired brick material into individual bricks.

3. A cutter frame as set forth in claim 1 wherein said mounting portion is concave on the side thereof opposite said cutter wire support surface.

4. A cutter frame as set forth in claim 3 wherein said mounting projection is shaped by deforming pressures causing plastic deformation of the metal forming said mounting projection without removing any metal from said mounting projection.

5. A cutter frame as set forth in claim 4 wherein the metal adjacent to said mounting portion is deformed to provide a step against which the associated cutter wire loop is seated.

* * * * *